US008830315B2

(12) United States Patent
Kang et al.

(10) Patent No.: US 8,830,315 B2
(45) Date of Patent: Sep. 9, 2014

(54) BRIDGE INSPECTING DEVICE AND METHOD

(75) Inventors: Shih-Chung Kang, Taipei (TW); Ping-Hung Lin, Taipei (TW)

(73) Assignee: National Taiwan University, Taipei (TW)

( * ) Notice: Subject to any disclaimer, the term of this patent is extended or adjusted under 35 U.S.C. 154(b) by 486 days.

(21) Appl. No.: 12/837,424

(22) Filed: Jul. 15, 2010

(65) Prior Publication Data

US 2011/0169939 A1 Jul. 14, 2011

(30) Foreign Application Priority Data

Jan. 14, 2010 (TW) ..... 99100993 A

(51) Int. Cl.
*H04N 7/18* (2006.01)
*E01D 19/10* (2006.01)

(52) U.S. Cl.
CPC ..... *E01D 19/106* (2013.01)
USPC ..... 348/82

(58) Field of Classification Search
CPC ..... H04N 7/18; E01D 19/106
USPC ..... 348/82
IPC ..... H04N 7/18
See application file for complete search history.

(56) References Cited

U.S. PATENT DOCUMENTS 3,916,701 A * 11/1975 Butler ..... 74/57
5,145,378 A * 9/1992 Rott et al. ..... 434/302
5,297,109 A * 3/1994 Barksdale et al. ..... 367/106
5,909,817 A * 6/1999 Wallace et al. ..... 212/275
6,543,578 B1 * 4/2003 Merz ..... 182/2.11
6,658,185 B2 * 12/2003 Bosisio et al. ..... 385/109
6,990,845 B2 * 1/2006 Voon et al. ..... 73/12.14
7,035,758 B1 * 4/2006 Jerome ..... 702/150
2005/0135915 A1 * 6/2005 Hall ..... 414/739
2009/0194498 A1 * 8/2009 Singhose et al. ..... 212/275

FOREIGN PATENT DOCUMENTS

GB 1417021 A * 12/1975
WO WO 2008107923 A1 * 9/2008

OTHER PUBLICATIONS

Chen et al., A Lightweight Imaged Based Bridge Inspection System Using Fishing Pole, Fishing Line and Fisheye Camera, Department of Civil Engineering, Natioan Taiwan University, Taipei, Taiwan.*
Neupert et al., Observer Design for Boom Cranes with Double-Pendulum Effect, 18th IEEE International Conference on Control Applications Part of 2009 IEEE Multi-conference on Systems and Control Saint Petersburg, Russia, Jul. 8-10, 2009.*
Ahmad et al., Feed-forward Techniques for Sway Suppression in a Double-Pendulum-Type Overhead Crane, 2009 International Conference on Computer Technology and Development.*

* cited by examiner

*Primary Examiner* — Jay Patel
*Assistant Examiner* — Francis G Geroleo

(57) ABSTRACT

The present invention relates to a bridge inspecting device for inspecting a structure of a bridge. The device includes a vehicle, a pendulum mechanism and at least one image sensing device. The vehicle has an arm and is stably parked at an edge of the bridge. The pendulum mechanism has an end movably secured to the arm and the pendulum mechanism has at least one pendulum element. The at least one image sensing device is connected to another end of the pendulum mechanism.

14 Claims, 3 Drawing Sheets

BRIDGE INSPECTING DEVICE AND METHOD

FIELD OF THE INVENTION

The present invention relates to a bridge inspecting device and an inspecting method. More particularly, it relates to a device and a method for inspecting a bridge's bottom.

BACKGROUND OF THE INVENTION

Taiwan region belongs to island climate and is located on the circum-pacific earthquake belt. The typhoon brings abounding rainfall during the flood period every year and causes the river to rise rapidly, so that the bridge and piers thereof are seriously damaged. It is often seen every year in Taiwan that the bridge is broken by typhoon and so forth because the piers of the bridge are destroyed by the river flood. Therefore, the management and inspecting for aged bridges in the country are very important and is of great urgency, especially for the high density urban areas.

As to the bridge inspecting, a non-destructive inspecting method are applied generally, such as a visual method, a rushing hammer method, an ultra-sonic method, concrete material inspecting method, an ultra-sonic inspecting method and so on. However, due to the work load and the budget, the office for managing the bridges adopts the non-destructive inspecting method, a visual inspecting and an evaluating method, to evaluate and inspect the bridges, such as Degree Extend Relevancy Urgency (D.E.R.U.) evaluating method or other evaluating method. The inspecting process is just performed by examining the whole parts of the bridge via human's eye and recording the damaged degree and position via taking picture or sketching.

Although the above visual inspecting is quick and simple and could save money and time, the evaluating process would easily cause human omissions and/or the subjective judgment of the inspector so that it has no objective standard and precision. Under such visual operating mode, inspections for some parts of the bridge are usually omitted on the condition that the inspector could not achieve the proper position, especially the bottom of the bridge surrounded by the special terrains/landforms. The office has tried to configure a camera to a C-shaped stand and to put down the stand from the edge of the bridge to catch the image of the bottom of the bridge, but the center of gravity is not so steady and the visual angle is constrained so that the effect is not good.

Therefore, it would be useful to invent a bridge inspecting device and an inspecting method to circumvent all the above issues. In order to fulfill this need the inventors have proposed an invention "BRIDGE INSPECTING DEVICE AND METHOD". The summary of the present invention is described as follows.

SUMMARY OF THE INVENTION

In the prior art, the conventional inspecting method or device for a bridge cannot effectively and properly examine the bottom of the bridge. The invention is to combine a pendulum system with an image sensing system, and using the pendulum principle to send the image sensing system into the bottom of the bridge so as to catch the image of the bridge bottom. The image is analyzed to complete the inspecting for the bridge and thereby the high efficiency and quality for inspecting could be achieved. Besides, it can be easily applied to inspecting the bottom of the bridge and effectively save the human resource and shorten the inspecting time. Furthermore, the present bridge inspecting device could be configured on a vehicle so that it has a high mobility and a portable convenience.

According to the first aspect of the present invention, a device for inspecting a structure of a bridge includes a vehicle having an arm; a pendulum mechanism having at least one pendulum element and two ends, one of which is secured to the arm; and at least one image sensing device connected to the other end of the pendulum mechanism.

Preferably, the device is provided, wherein the at least one pendulum element is one selected from a group consisting of a bar, a rope and a combination thereof, and the one end is optionally moved to a specific position of the arm and secured thereon.

Preferably, the device is provided, wherein the bar is a rigid bar and the rope is a soft rope.

Preferably, the device is provided, wherein the bar is one selected from a group consisting of a steel bar, an aluminum bar, an alloy bar and a combination thereof, and the rope is one selected from a group consisting of a steel rope, a wire rope, a carbon fiber rope, a fiber polymer rope, a high molecular polymer rope and a combination thereof.

Preferably, the device is provided, wherein the arm is a telescopic boom, the at least one image sensing device is a camera, and the vehicle a hoist or an engineering vehicle.

Preferably, the device is provided, wherein the pendulum mechanism includes two pendulum elements and a joint connecting the two pendulum elements.

Preferably, the device is disposed at an edge of the bridge and further includes a connector connecting the arm and the pendulum mechanism and a driving device driving the pendulum mechanism to swing.

According to the second aspect of the present invention, a bridge inspecting device includes an arm; a pendulum mechanism having at least two ends, one of which is connected to the arm; and an image sensing device connected to the other end of the pendulum mechanism.

Preferably, the device is provided, wherein the aim is disposed at an edge of a bridge, and the image sensing device is rotatable for taking images at a predetermined angle.

According to the third aspect of the present invention, an inspecting method for a bridge includes the steps of: (A) providing a pendulum mechanism with an image sensing device; (B) swing the pendulum mechanism; and (C) grabbing an image of the bridge through the image sensing device.

Preferably, the method further includes the step (B0) of driving the pendulum mechanism to swing with a predetermined mode, wherein the predetermined mode is one of a synchronous swing mode and a non-synchronous swing mode. Besides, the pendulum mechanism has two ends, one of the two ends fixed to an arm which is disposed at an edge of the bridge, and the other of the two ends is coupled to the image sensing device.

The foregoing and other features and advantages of the present invention will be more clearly understood through the following descriptions with reference to the drawings:

DETAILED DESCRIPTION OF THE PREFERRED EMBODIMENT

The present invention will now be described more specifically with reference to the following embodiments. It is to be noted that the following descriptions of preferred embodiments of this invention are presented herein for the aspect of illustration and description only; it is not intended to be exhaustive or to be limited to the precise from disclosed.

Figure 1:
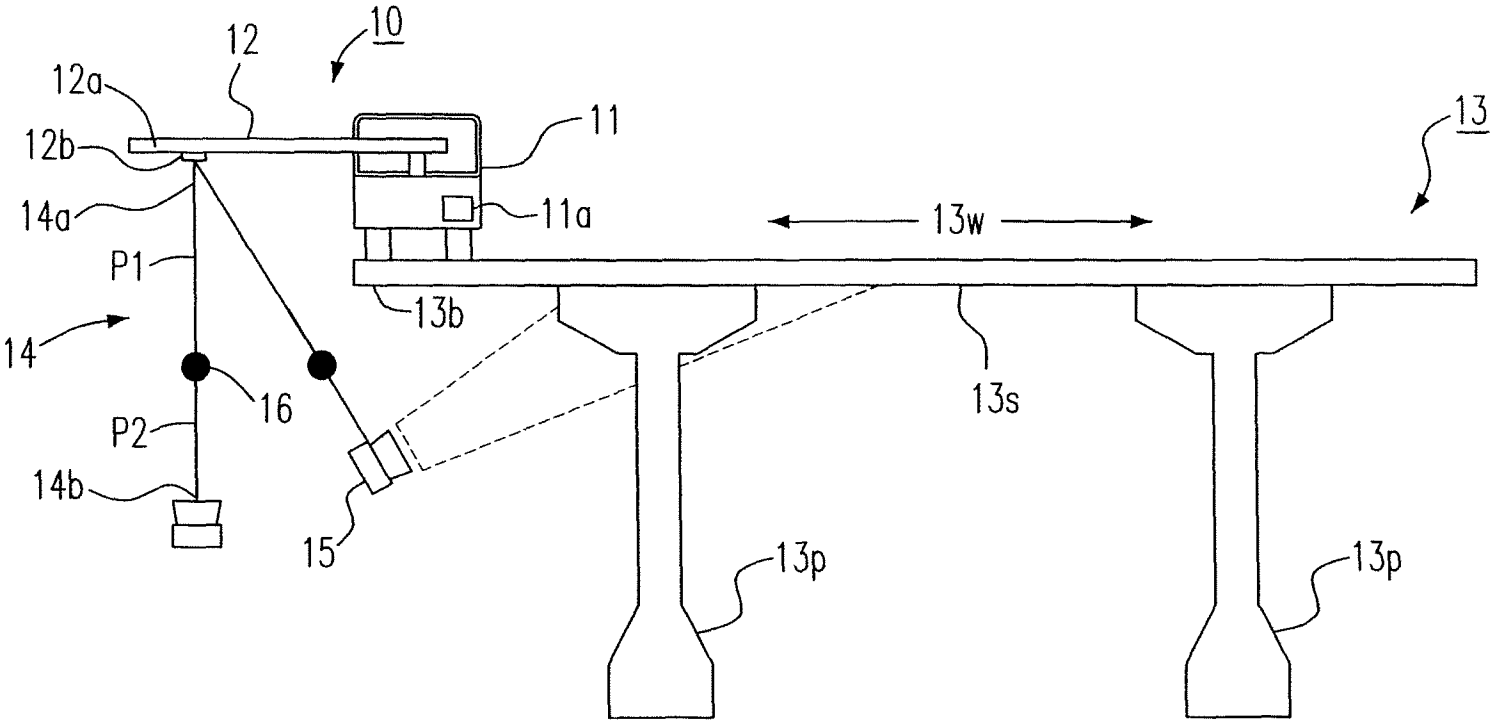
FIG. 1 is a diagram illustrating the first preferred embodiment according to the present invention.

Please refer to FIG. 1 which is a diagram illustrating the first preferred embodiment according to the present invention. The bridge inspecting device 10 includes a vehicle 11, an arm 12, a pendulum mechanism 14 and an image sensing device 15. Preferably, the bridge inspecting device 10 is stably disposed or parks at the edge 13*b* of the bridge 13, so-called the position near the shoulder, so as to facilitate the inspecting when inspecting the bridge 13. The bridge 13 shown in FIG. 1 indicates the transverse section of the bridge 13 to be inspected. The longitudinal direction is the proceeding direction of cars and extends along the direction perpendicular to the paper. The bridge 13 has a width 13*w* and a pier 13*p*.

The vehicle 11 is used for carrying the arm 12, and is preferably a hoist or an engineering vehicle. Preferably, the arm 12 is a telescopic boom. The arm 12 can extend in the transverse direction and protrude from the edge 13*b* of the bridge 13. The arm 12 is configured to suspend the pendulum mechanism 14, and a terminal 12*a* of the arm 12 is coupled to an end 14*b* of the pendulum mechanism 14 via a connector 12*b* such as a ring and so on. The position of the connector 12*b* is changeable depending on the situation. The other end 14*b* of the pendulum mechanism 14 is coupled to at least one image sensing device 15 such as digital camera, a video camera or other device capable of catching images. It is noted that the pendulum mechanism 14 could has at least two ends.

The pendulum mechanism 14 includes at least one pendulum element P. Preferably, the pendulum element P is a bar, a rope or a combination thereof. The bar could be a rigid bar and the rope could be a soft rope. Furthermore, the bar could be a steel bar, an aluminum bar, an alloy bar or a combination thereof, and the rope could be a steel rope, a wire rope, a carbon fiber rope, a fiber polymer rope, a high molecular polymer or a combination thereof. Usually, a cable consists of a plurality of ropes. Taking FIG. 1 for example, the pendulum mechanism 14 is designed based on double pendulum. Namely, the pendulum mechanism 14 has two pendulum elements P1 and P2. The two pendulum elements P1 and P2 are pivotally connected to each other via a joint 16.

After the bridge inspecting device 10 is disposed/configured on the bridge 13, the inspecting method of the present invention could be performed. When the structure of the bridge 13 is sought to be inspected, especially the structure of the bottom 13*s*, the pendulum mechanism 14 is driven to swing at a specific frequency, whereby the image sensing device 15 can be sent into the area below the bottom of the bridge 13 and catches images of the bottom 13*s*. Furthermore, the during the swinging process, there would be enough time for the image sensing device 15 to take pictures continuously so as to completely obtain images regarding the whole bottom 13*s*. Finally, the image stitch technique is applied to combine the images for adjacent senses so as to obtain the complete image of the bridge 13. The task for inspecting the bottom 13*s* could be achieved by the inspector via reviewing the combined image. It is noted that the bridge inspecting device 10 could has a driving device 11*a* configured on the vehicle 11 to drive the pendulum mechanism to swing. The end 14*b* could be optionally moved to a specific position of the arm 12 and secured thereon. Besides, the image sensing device 15 could be rotatable for taking images at a predetermined angle.

When examining, the engineer could introduce various analysis methods to detailedly analyze the image for the bridge. Therefore, the engineer can precisely and objectively investigate any possible damages at the underside of the bridge.

It is noted that the swings of the two pendulum elements P1 and P2 could be performed at a synchronous swing mode with the same frequency or at a non-synchronous swing mode with the different frequencies. For instance, the pendulum mechanism 14 shown in FIG. 1 is designed based on double pendulum, but the two pendulum elements P1 and P2 is performed at a synchronous swing mode. Therefore, the two pendulum elements P1 and P2 form a line when swinging. By the same token, it is the same situation if there are more than two pendulum elements.

Figure 2:
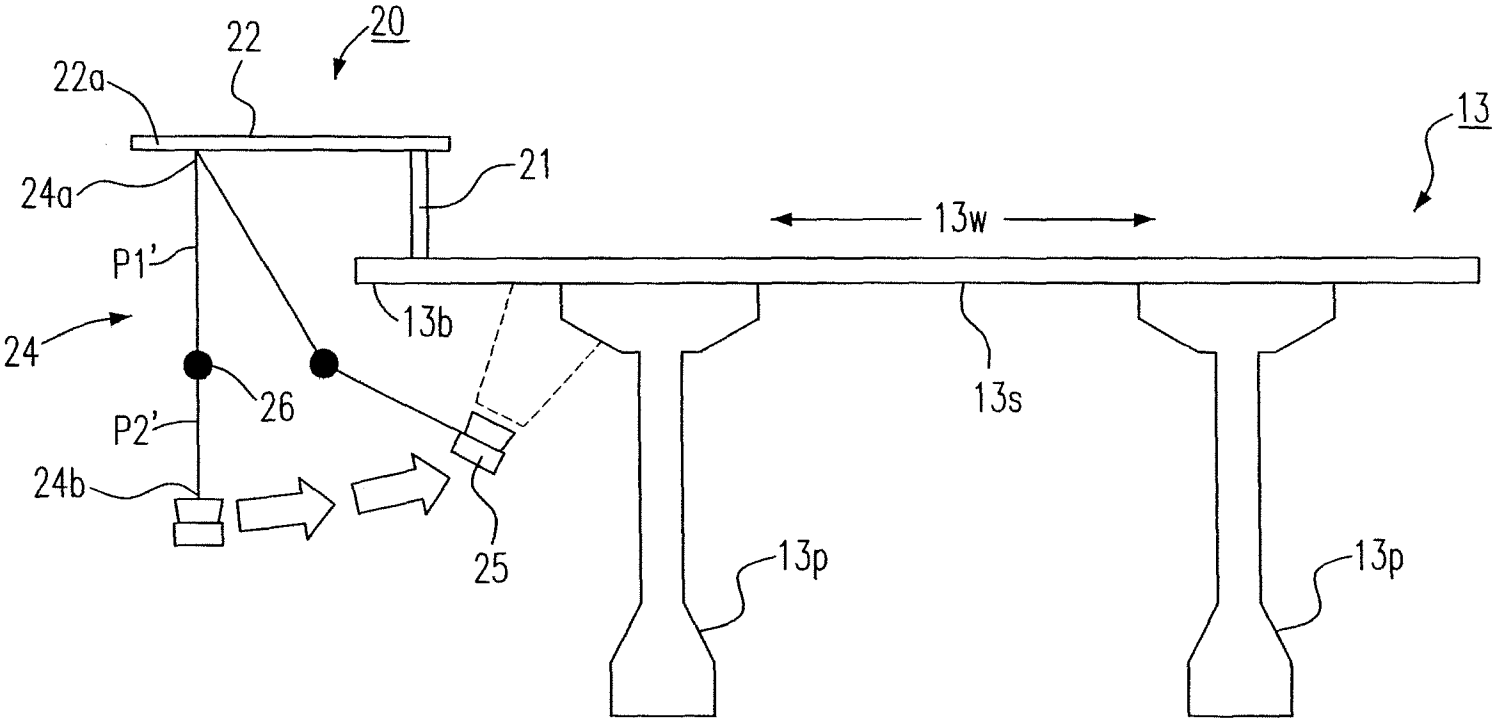
FIG. 2 is a flowchart illustrating the second preferred embodiment according to the present invention.

Please refer to FIG. 2 which is a diagram illustrating the second preferred embodiment according to the present invention. The bridge inspecting device 20 includes a movable base 21, an arm 22, a pendulum mechanism 24 and an image sensing device 15. The movable base 21 is configured to carry the arm 22. The pendulum mechanism 24 has at least two ends 24*a* and 24*b*. The end 24*a* is disposed to the aim 22, and the image sensing device 25 mechanically connected to the other end 24*b* of the pendulum mechanism 24. Preferably, the movable base is stably disposed at the edge 13*b* of the bridge 13 so as to facilitate the inspecting when inspecting the bridge 13. The pendulum mechanism 24 shown in FIG. 2 is also designed based on double pendulum, but the two pendulum elements P1' and P2' is performed at a non-synchronous swing mode. Therefore, the two pendulum elements P1' and P2' form a bending line or a refracting line when swinging. The image sensing device 25 could be delivered more nearer the bottom 13*s* or the underside of the edge 13 to grab/catch images for analysis and inspection. Namely, the non-synchronous swing mode can eliminate the blind angle the synchronous swing mode may have, to further obtain more precise and complete information for an underside of central part of the bottom 13*s*.

Figure 3:
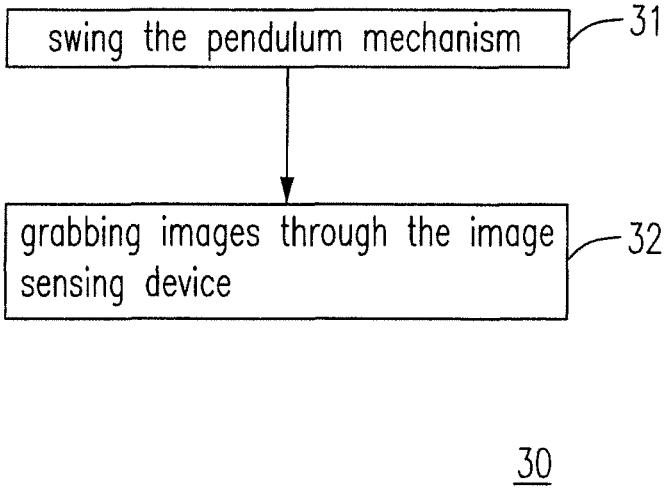
FIG. 3 is a diagram illustrating the first preferred inspecting method according to the present invention.

Please refer to FIG. 3 which is a diagram illustrating the first preferred inspecting method according to the present invention. An inspecting method 30 used for inspecting a bridge via a pendulum mechanism with an image sensing device is consequently derived from the above-mentioned disclosure. The inspecting method 30 includes the step 31 of swing the pendulum mechanism and the step 32 of catching images through the image sensing device. Furthermore, the inspecting method 30 can further include a step of driving the pendulum mechanism to swing with a predetermined mode, and the predetermined mode is one of a synchronous swing mode and a non-synchronous swing mode.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims, which are to be accorded with the broadest interpretation so as to encompass all such modifications and similar structures. Therefore the above description and illustration should not be taken as limiting the scope of the present invention which is defined by the appended claims.

What is claimed is:

1. A device for inspecting a structure of a bridge, comprising:

a vehicle having an arm;

at least one image sensing device; and a pendulum mechanism consisting of a first pendulum element, a second pendulum element and a joint connecting the first and the second pendulum elements, wherein the first pendulum element has a first end secured to the arm, the second pendulum elements has a second end connected to the at least one image sensing device grabbing an image of a bottom of the bridge, wherein the arm is configured to suspend the pendulum mechanism to be driven to swing freely back and forth, with respect to the arm at the first end, with a non-synchronous swing mode by using a pendulum principle such that the at least one image sensing device swings back and forth and reaches positions in proximity with a bottom of the bridge, and the first and the second pendulum elements are rigid bars;

wherein the at least one image sensing device is configured to take images when the at least one image sensing device reaches the positions in proximity with the bottom of the bridge during the pendulum mechanism swinging freely back and forth, and wherein an image stitch technique is applied to combine the images taken when the at least one image sensing device reaches the positions in proximity with the bottom of the bridge to obtain a complete image of the bridge.

2. The device as claimed in claim 1, wherein the first end is optionally moved to a specific position of the arm and secured thereon.

3. The device as claimed in claim 1, wherein the rigid bar is one selected from a group consisting of a steel bar, an aluminum bar, an alloy bar and a combination thereof.

4. The device as claimed in claim 1, wherein the arm is a telescopic boom.

5. The device as claimed in claim 1, wherein the at least one image sensing device is a camera.

6. The device as claimed in claim 1, wherein the vehicle is one of a hoist and an engineering vehicle.

7. The device as claimed in claim 1 being disposed at an edge of the bridge.

8. The device as claimed in claim 1 further comprising a connector connecting the arm and the pendulum mechanism.

9. The device as claimed in claim 1 further comprising a driving device driving the pendulum mechanism to swing.

10. A bridge inspecting device, comprising:

an arm;

a pendulum mechanism having a first end secured to the arm, a second end, a first pendulum element, a second pendulum element and a joint connecting the first and the second pendulum elements; and at least one image sensing device connected to the second end of the pendulum mechanism grabbing an image of a bottom of the bridge;

wherein the arm is configured to suspend the pendulum mechanism to be driven to swing freely back and forth, with respect to the arm at the first end, with a non-synchronous swing mode by using a pendulum principle such that the at least one image sensing device swings back and forth and reaches positions in proximity with a bottom of the bridge;

wherein the at least one image sensing device is configured to take images when the at least one image sensing device reaches the positions in proximity with the bottom of the bridge during the pendulum mechanism swinging freely back and forth, and wherein an image stitch technique is applied to combine the images taken when the at least one image sensing device reaches the positions in proximity with the bottom of the bridge to obtain a complete image of the bridge.

11. The bridge inspecting device as claimed in claim 10, wherein the arm is disposed at an edge of a bridge.

12. The bridge inspecting device as claimed in claim 10, wherein the image sensing device is rotatable for taking images at a predetermined angle.

13. An inspecting method for a bridge, comprising the steps of:

providing a pendulum mechanism with at least two pendulum elements and at least one image sensing device, wherein the pendulum mechanism has two ends, one of the two ends is fixed to an arm which is disposed at an edge of the bridge, and the other of the two ends is coupled to the at least one image sensing device;

driving the pendulum mechanism to swing back and forth with a non-synchronous swing mode by using a pendulum principle such that the at least one image sensing device swings back and forth and reaches positions in proximity with a bottom of the bridge; and grabbing images of the bottom of the bridge through the at least one image sensing device during the pendulum mechanism being driven to swing freely back and forth, wherein an image stitch technique is applied to combine the images taken when the at least one image sensing device reaches the positions in proximity with the bottom of the bridge to obtain a complete image of the bridge.

14. The inspecting method as claimed in claim 13 further comprising a step of driving the pendulum mechanism to swing with a synchronous swing mode and then grabbing another image of the bridge.

* * * * *